United States Patent [19]

Steiner

[11] Patent Number: 5,003,715

[45] Date of Patent: Apr. 2, 1991

[54] PAINTED DISPLAY ASSEMBLY

[76] Inventor: Norm Steiner, 230 174th St., Apt. 717, Miami Beach, Fla. 33160

[21] Appl. No.: 519,631

[22] Filed: May 7, 1990

[51] Int. Cl.[5] ..... G09F 13/00

[52] U.S. Cl. ..... 40/442; 40/427

[58] Field of Search ..... 40/443, 564, 575, 152.2, 40/156, 442, 615, 160, 441, 449, 427, 436

[56] References Cited

U.S. PATENT DOCUMENTS

| | | | |
|---|---|---|---|
| 230,741 | 8/1880 | Caldwell | 40/443 |
| 663,430 | 12/1900 | Gilman | 40/443 |
| 770,319 | 9/1904 | von Ridiger | 40/443 |
| 1,411,439 | 4/1922 | Keller | 40/443 |
| 1,881,417 | 10/1932 | Hodgkin | 40/443 |
| 1,899,962 | 3/1933 | Higginbottom | 40/442 |
| 1,990,825 | 2/1935 | Hodgkin | 40/443 |
| 2,070,132 | 2/1937 | Kamm | 40/443 |
| 2,118,320 | 5/1937 | McEwen | 40/443 |
| 2,143,141 | 1/1939 | Cooley | 40/615 |
| 2,201,809 | 5/1940 | Brown | 40/443 |
| 2,812,607 | 11/1957 | Briggs | 40/443 |
| 3,318,032 | 5/1967 | Robison et al. | 40/152.2 |
| 3,745,678 | 7/1973 | Thomassen | 40/442 |
| 4,055,014 | 10/1977 | Schmidt et al. | 40/442 |
| 4,277,904 | 7/1981 | Leuthesser | 40/564 |
| 4,922,384 | 5/1990 | Torrence | 40/442 |

FOREIGN PATENT DOCUMENTS

| | | | |
|---|---|---|---|
| 901731 | 11/1953 | Fed. Rep. of Germany | 40/442 |

*Primary Examiner*—Kenneth J. Dorner
*Assistant Examiner*—Cassandra Hope
*Attorney, Agent, or Firm*—Malloy, Downey & Malloy

[57] ABSTRACT

A painted display assembly comprising a sheet adapted for the passage of light therethrough and including an exposed front face and a rear face each having painted portions thereon, the sheet being mounted to one side of a mounting frame having an open center wherein the sheet is disposed in covering relation to the open center. A light assembly including a light source is mounted to an opposite side of the mounting frame and is specifically adapted to direct light on to the rear face of the sheet wherein a background scene appears in relation to a painted main scene within a frame viewing surface on the exposed front face.

13 Claims, 2 Drawing Sheets

PAINTED DISPLAY ASSEMBLY

BACKGROUND OF THE INVENTION

1. Field of the Invention

A painted display assembly comprising a substantially translucent material having painted portions on opposite sides and mounted to a light directing assembly for passage of light therethrough giving the effect of a three dimensional scene comprising a main scene and a background scene.

2. Description of the Prior Art

The prior art is crowded with various painted displays having some type of light structure adapted for directing light either on an exposed surface or through the painted material from a rear surface to give an illuminated effect to a painting. However, nowhere in the prior art is there any disclosure of a painted display wherein both a front exposed surface is painted, and an opposite rear surface is painted such that light directed onto the rear surface provides a three dimensional effect to the painted display, the display including a main scene and a background scene wherein the background scene is only being visible once light is directed onto the rear surface.

Accordingly, the Applicant has developed a new and unique painted display assembly specifically designed to give a three dimensional effect to what would normally appear to be an ordinary painting, the invention to be described in greater detail in the description which follows.

SUMMARY OF THE INVENTION

The present invention is directed towards a painted display assembly of the type normally to be mounted or hung on a wall in a preferred viewing orientation for one's viewing pleasure. While the preferred embodiment of the present invention is directed for use with canvas type paintings, it should be emphasized that any suitable transparent or translucent material, adapted to be painted on such as glass, Plexiglas TM or artist paper, could also be used to accomplish the intended purpose of the invention. Additionally, any suitable paint including acrylic, water color, or oil paint are adaptable for use with the present invention.

The painted display assembly of the present invention includes a light transmitting material mounted to a mounting frame or rack structure wherein the material includes an exposed front face having a painted scene thereon and a rear face having additional painted scenes or figures thereon. The display assembly further includes a light assembly including a light source mounted to a light directing box having an open side mounted to the mounting rack in covering relation to the rear surface of the painted material, such that light emitted from the light source is directed onto the rear surface.

The painted scene on the exposed front face includes dark, opaque painted areas of concentrated paint blocking the passage of light through the light transmitting material. The painted scene on the exposed front face further includes translucent painted areas comprised of paint being sufficiently diluted to permit at least the partial passage of light therethrough. The rear surface of the light transmitting material includes a background scene comprised of dark, opaque painted areas which are adapted to block the passage of light through the material.

A frame is mounted in overlying, surrounding relation to the exposed front surface defining a border around a painted scene.

Accordingly, as light is directed onto the rear surface, the light transmitting material is illuminated wherein a background scene appears giving a three dimensional effect to the main scene on the exposed surface.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
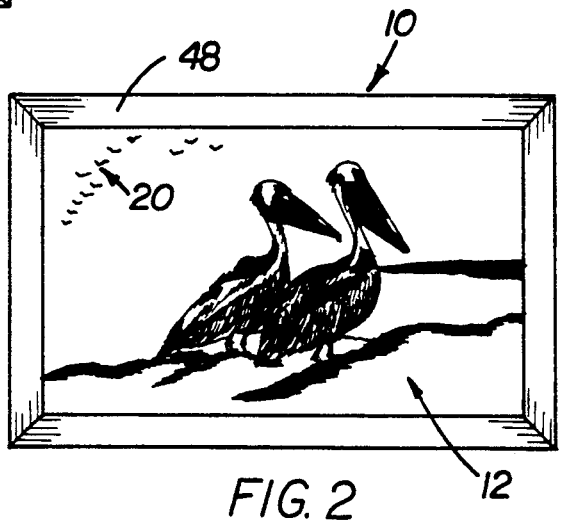
FIG. 2 is a front plan view of the display assembly in an illuminated state.
Figure 3:
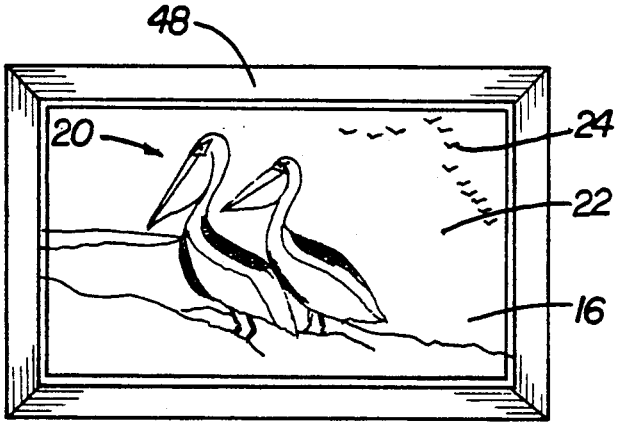
FIG. 3 is a rear plan view illustrating the rear painted surface of the light transmitting material.
Figure 4:
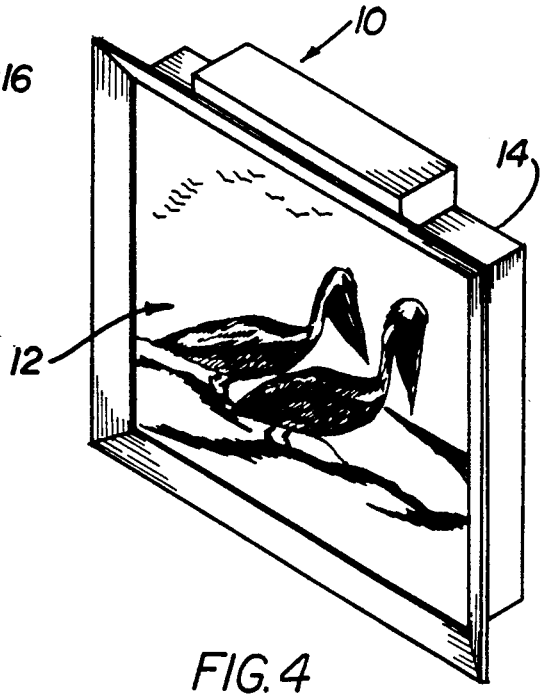
FIG. 4 is a perspective view of a preferred embodiment of the painted display assembly.

As shown in FIGS. 1 through 7, the present invention is directed towards a painted display assembly generally indicated as 10, the assembly including a framed painted display 12 and a light assembly 14 mounted thereto, as shown in FIG. 4. The painted display includes a sheet of light transmitting material 16 having a painted main scene thereon including painted opaque areas 18 and translucent areas 19. The dark opaque areas 18 consist of concentrated paint of a sufficient darkness to prevent the passage of light through the sheet of material 16. The translucent painted portions 19 consist of less concentrated paint which is sufficiently diluted to permit at least a partial passage of light through the material 16.

Figure 1:
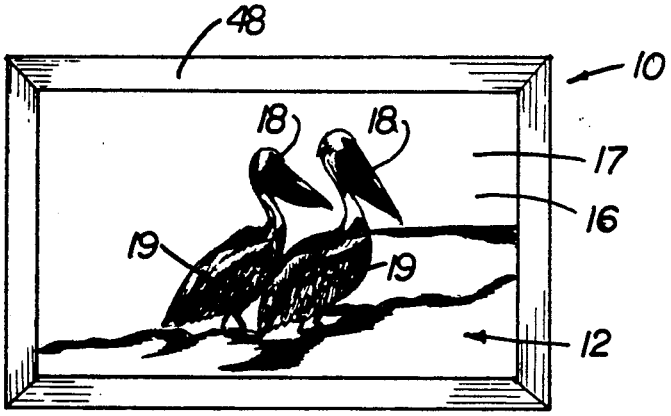
FIG. 1 is a front plan view of the display assembly illustrating the main scene on the exposed front surface of the assembly in a non-illuminated state.

Referring to FIG. 3, a secondary background scene generally indicated as 20 is painted on a rear surface 22 of the material 16 and generally comprises dark painted areas 24 being of a sufficient density to block the passage of light through the material 16. Accordingly, FIG. 1 represents the painted scene 12 wherein no light is being directed through the material 16 and FIG. 2 represents the painted scene 12 in an illuminated state wherein light is being directed through the material and a background scene generally indicated as 20 appears giving the entire display a three dimensional appearance.

Figure 5:
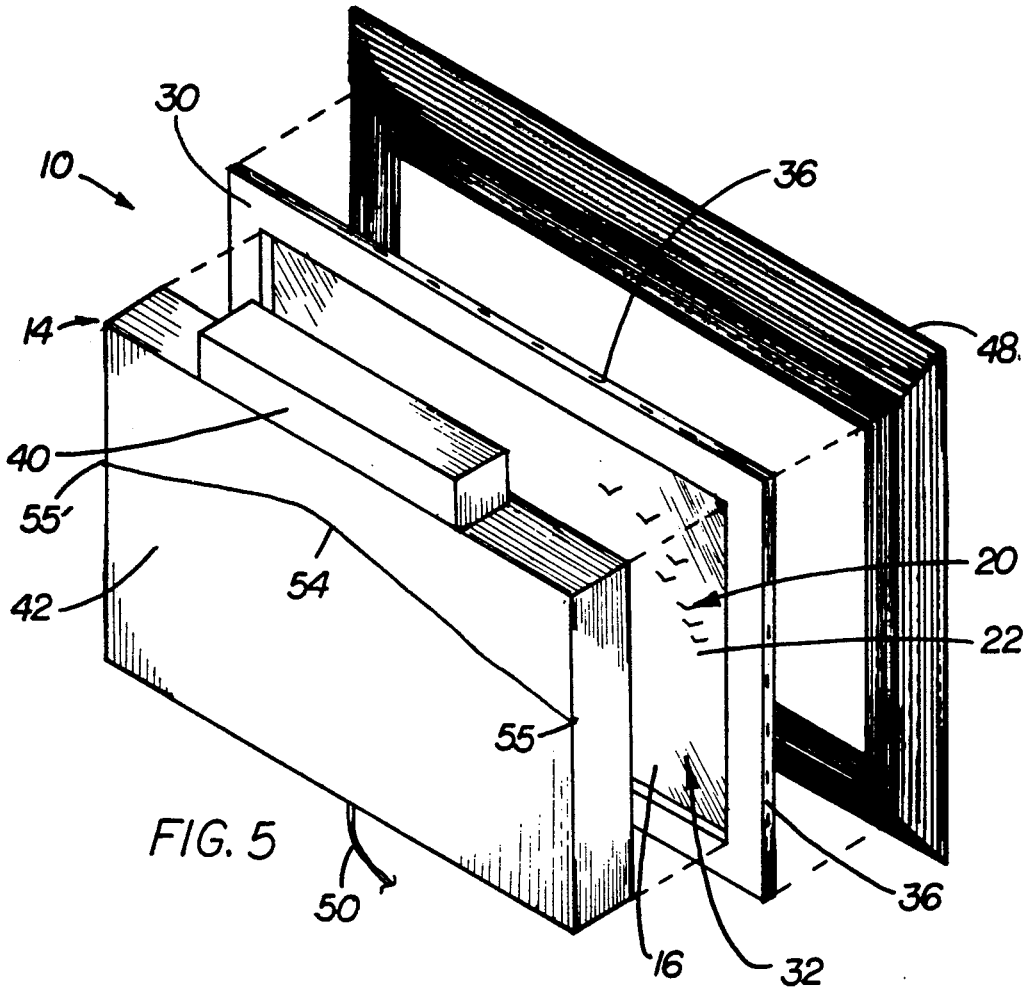
FIG. 5 is an exploded view of the display assembly.
Figure 6:
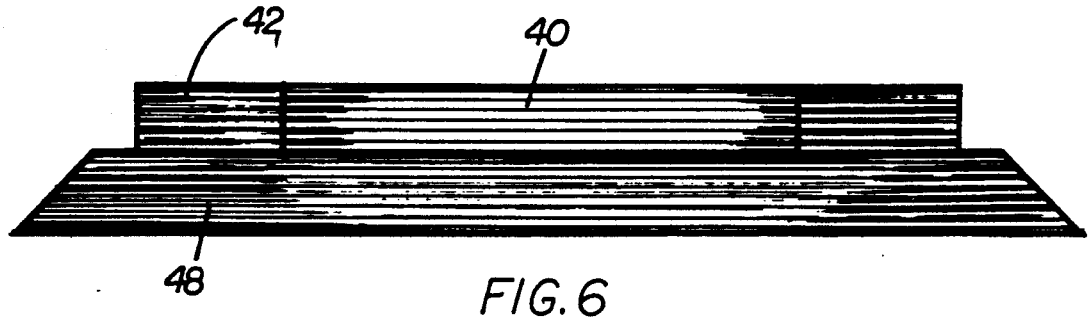
FIG. 6 is a top plan view of the display assembly.
Figure 7:
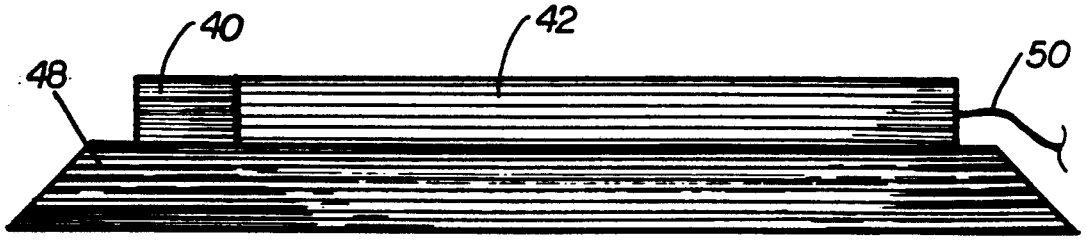
FIG. 7 is a side plan view of the display assembly.

With reference to FIG. 5, the preferred embodiment of the present invention comprises a mounting rack 30 generally comprising a plurality of wooden slats interconnected at their opposite ends to form a frame structure having an open center as at 32. In a preferred embodiment, a stretch canvas representing the light transmitting material 16 is stretched and mounted to the rack 30 along a surrounding peripheral edge 36. A light assembly generally indicated as 14 is mounted to the rack 30 and comprises a light source, not shown, mounted in light transmitting connection with a light directing structure, generally in the form of a box 42 which is specifically structured to direct the light onto the rear surface 22 of the sheet of material 16. In the preferred embodiment, the light assembly 14 generally comprises a lamp structure comprising a box like casing having a light bulb mounted therein and ordinarily being powered by an electric current either from a battery or an electrical outlet. The light bulb casing of the light source is specifically structured to be mounted to the light directing box 42 such that light is dispersed into the box structure 42 and thereafter, directed onto the rear surface 22 of the light transmitting material 16.

A picture frame 48 is ordinarily mounted to an opposite side of the rack 30 in surrounding relation to the outer exposed surface 17 of the light transmitting material 16. In a preferred embodiment, the picture frame 48 is specifically structured to be mounted to the rack 30 in covering relation to the rack structure and a surrounding border of the material 16 so that only that portion of the exposed face 17 which covers the open center 32 of the mounting rack 30 is visible to the viewer thereby providing a preferred viewing surface comprising an entire illuminated display within the picture frame 48.

The light assembly 14 in the preferred embodiment of the present invention is electrically powered through a standard electrical conductor cord 50 adapted to be plugged into a standard electrical outlet. Additionally, mounting means are provided to facilitate mounting of the entire display assembly on a wall or other suitable mounting surface for providing a preferred viewing orientation of the assembly. The mounting means is preferably in the form of an elongate wire 54 having opposite ends connected to the back of the light directing structure 42 as at 55 and 55'.

Now that the invention has been described,

What is claimed is:

1. A painted display assembly comprising:

a. a mounting rack having a frame structure and including a plurality of slats interconnected with one another at opposite ends in surrounding relation to an open center, b. a sheet of light transmitting material including an exposed front face and an oppositely disposed rear face, said sheet mounted to said mounting rack around a peripheral edge of said sheet in covering relation to said open center, c. a light assembly including a light source mounted to a light directing means for directing light through said sheet, said light directing means mounted to an opposite side of said mounting rack, congruent to said sheet in surrounding, covering relation to said open center, d. a main painted portion on said exposed front face including opaque areas of concentrated paint sufficiently blocking the passage of light therethrough and translucent areas of diluted paint, said translucent areas adapted to permit at least partial transmission of light therethrough, e. a secondary painted portion on said rear face comprising secondary dark, opaque painted areas in blocking relation to light passing through said sheet defining a background image, and f. a picture frame mounted to said mounting rack substantially covering a peripheral edge of said exposed front face of said sheet in surrounding relation to a viewing surface on said exposed front face.

2. A display assembly as in claim 1 wherein said mounting rack includes a plurality of wood slats interconnected with one another at opposite ends in surrounding relation to said open center.

3. A display assembly as in claim 2 wherein said sheet of light transmitting material is formed of stretch canvas and is adapted to be stretched and mounted on said mounting rack in covering relation to said open center.

4. A display assembly as in claim 1 wherein said sheet of light transmitting material is formed of glass.

5. A display assembly as in claim 1 wherein said sheet of light transmitting material is formed of a substantially transparent, rigid plastic material.

6. A display assembly as in claim 1 wherein said light source includes an electrically powered light including a light casing and light bulb assembly having an open end mounted in light dispersing relation to said light directing means.

7. A display assembly as in claim 6 wherein said light directing means includes a box assembly having an open side mounted to said mounting rack in covering, light directing relation to said open center, whereby light emitted from said light source is dispersed throughout said box assembly and directed onto said rear face of said sheet.

8. A display assembly as in claim 1 wherein said main painted portion defines a painted scene on said exposed front face including said opaque areas of concentrated paint sufficiently blocking the passage of light through said sheet, and translucent areas of diluted paint allowing at least partial passage of light through said sheet wherein at least a portion of said painted scene has an illuminated appearance.

9. A display assembly as in claim 8 wherein said secondary painted portion on said rear face comprises said secondary dark, opaque painted areas in blocking relation to the passage of light through said sheet, said secondary painted portion defining said background image of said painted scene when said light source is activated thereby illuminating said viewing surface on said exposed front face.

10. A display assembly as in claim 1 wherein said light source is battery powered.

11. A display assembly as in claim 1 wherein said light source is electrically powered and includes an electrically conductive cord adapted to be plugged into a standard electrical outlet.

12. A display assembly as in claim 1 wherein said assembly includes hanging means to hang said assembly on a suitable mounting surface.

13. A display assembly as in claim 12 wherein said hanging means includes an elongate wire connected at opposite ends to a rear surface of said light directing means.

* * * * *